United States Patent [19]

Belfer

[11] 4,004,495

[45] Jan. 25, 1977

[54] CONSTANT RECOIL SYSTEM

[75] Inventor: Warren B. Belfer, Davenport, Iowa

[73] Assignee: The United States of America as represented by the Secretary of the Army, Washington, D.C.

[22] Filed: Dec. 15, 1975

[21] Appl. No.: 641,198

[52] U.S. Cl. ..... 89/42 B

[51] Int. Cl.[2] ..... F41F 19/00

[58] Field of Search ..... 89/42 B

[56] References Cited

UNITED STATES PATENTS 3,677,135 7/1972 Haug ..... 89/42 B

*Primary Examiner*—Stephen C. Bentley
*Attorney, Agent, or Firm*—Nathan Edelberg; Harold H. Card, Jr.; Robert O. Richardson

[57] ABSTRACT

A mounting system for heavy caliber rapid firing weapons has a sensor responsive to gun motion during recoil. The sensor provides an electrical signal used to adjust the rate of gunfire so that counter-recoil movement of the gun upon firing each round is substantially canceled by firing the next subsequent round, whereby oscillatory shock loads transmitted through the mounting structure are greatly attenuated and converted to a relatively constant load value.

7 Claims, 3 Drawing Figures

FIG. 1

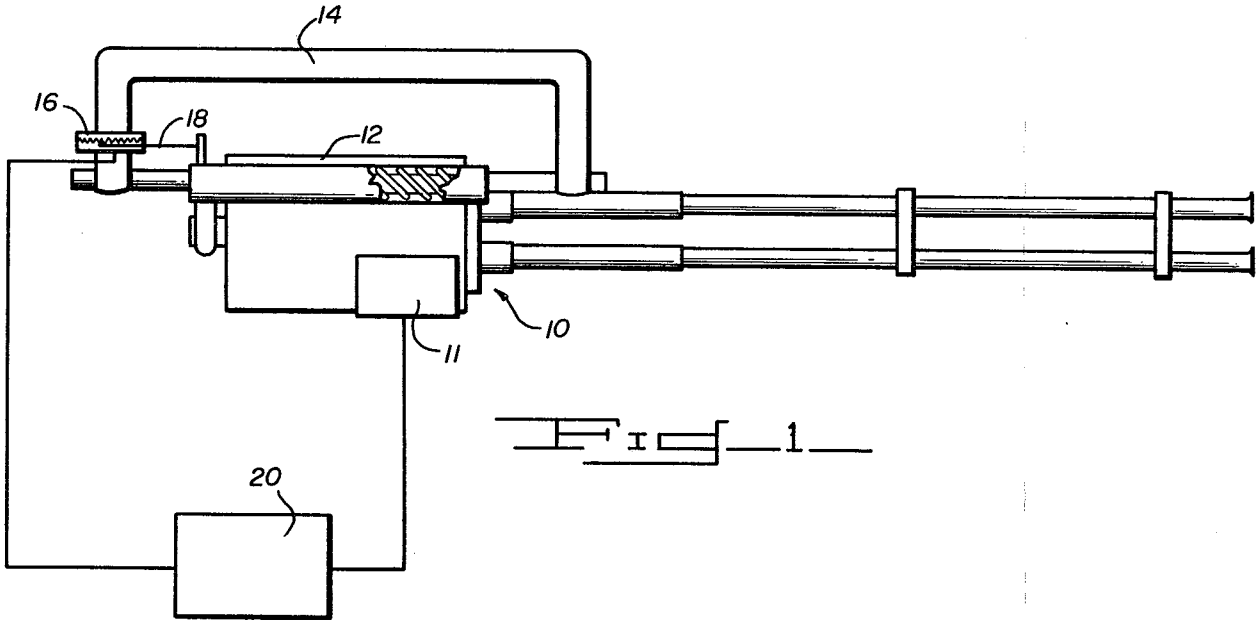
10
11
12
14
16
18
20
1

CONSTANT RECOIL SYSTEM

BACKGROUND OF THE INVENTION

Modern weapons for tactical warfare include a variety of rapid firing guns adapted for relatively large calibre ammunition. During sustained bursts of gunfire, the mounts for such weapons characteristically are required to withstand repeated shock loads which will vary depending upon factors such as the mass of recoiling parts in the gun and the size of charge in each round. This type of load is typically a high peak stress similar to a sudden hammer blow, and stress fatigue in metals is particularly severe where this type loading is applied. The useful service life of a metal part may be as much as four times longer under continuous loading conditions than for the same part subjected to repeated shock loads.

The foregoing considerations have limited some type of weapons to ground use although they could be most effective in light weight aircraft such as helicopters. Cannons which employ the familiar Gatling principle of operation are an example. Thus, Gatling type weapons produce severe peak loads of the oscillatory type, and cannot be mounted or safely fired in helicopters because of the high risk of metal fatigue resulting in the gun support aircraft structure, as well as control in stability of the vehicle and the weapon both. If gun mounts of sufficient mass and bulk are used on such guns, the resulting installation is too heavy for all but large aircraft, and the weapon becomes totally impractical.

SUMMARY OF THE INVENTION

The invention comprises a system adapted for use with mounts supporting rapid-fire weapons such as Gatling type cannons or the like. The system as seen in FIG. 1 is operatively related to Gatling type cannon 10 having shock dissipating recoil means including stationary spring pack 12 operatively connected to yoke 14 which moves rearwardly during recoil and returns to a full forward position when firing ceases. Gun 10 is driven by a motor 11 so that the gunfire rate depends directly upon the speed of drive motor 11.

Mounted on yoke 14 is a sensing device comprising a displacement transducer 16 of conventional type operatively related with a relatively stationary contact element 18. Voltage is supplied from a suitable constant output source so that an electrical signal is produced by contact 18 and transducer 16 during their relative movement, the stored signal being proportionate to the amount of such movement.

The signal thus obtained from sensor transducer 16, contact 18 is supplied through suitable leads to a motor control unit 20 which amplifies the same and feeds the amplified signal to the field and/or armature windings in motor 11. The speed of motor 11, hence the firing rate of gun 10, is determined by the strength of the signal input to the motor.

By calibrating the electrical characteristics of the transducer 16, motor 11 and motor controller 20 in order to coordinate recoil movements of gun 10 with firing impulses, it has been found possible to cancel most counter-recoiling movement of yoke 14 after firing each round by firing the next subsequent round at an appropriate instant. The stated coordination of successive rounds during a single substained burst results in the recoil mechanism of gun 10 displacing rearwardly a certain distance when firing begins and remaining substantially at the same position of displacement throughout the burst, thus avoiding the severe oscillatory recoil counter-recoil type of movement which would otherwise result.

BRIEF DESCRIPTION OF THE DRAWINGS

FIG. 2 shows a schematic view of circuity adapted for use in connecting the electrical components shown in FIG. 1.

DESCRIPTION OF THE PREFERRED EMBODIMENT

Figure 1:
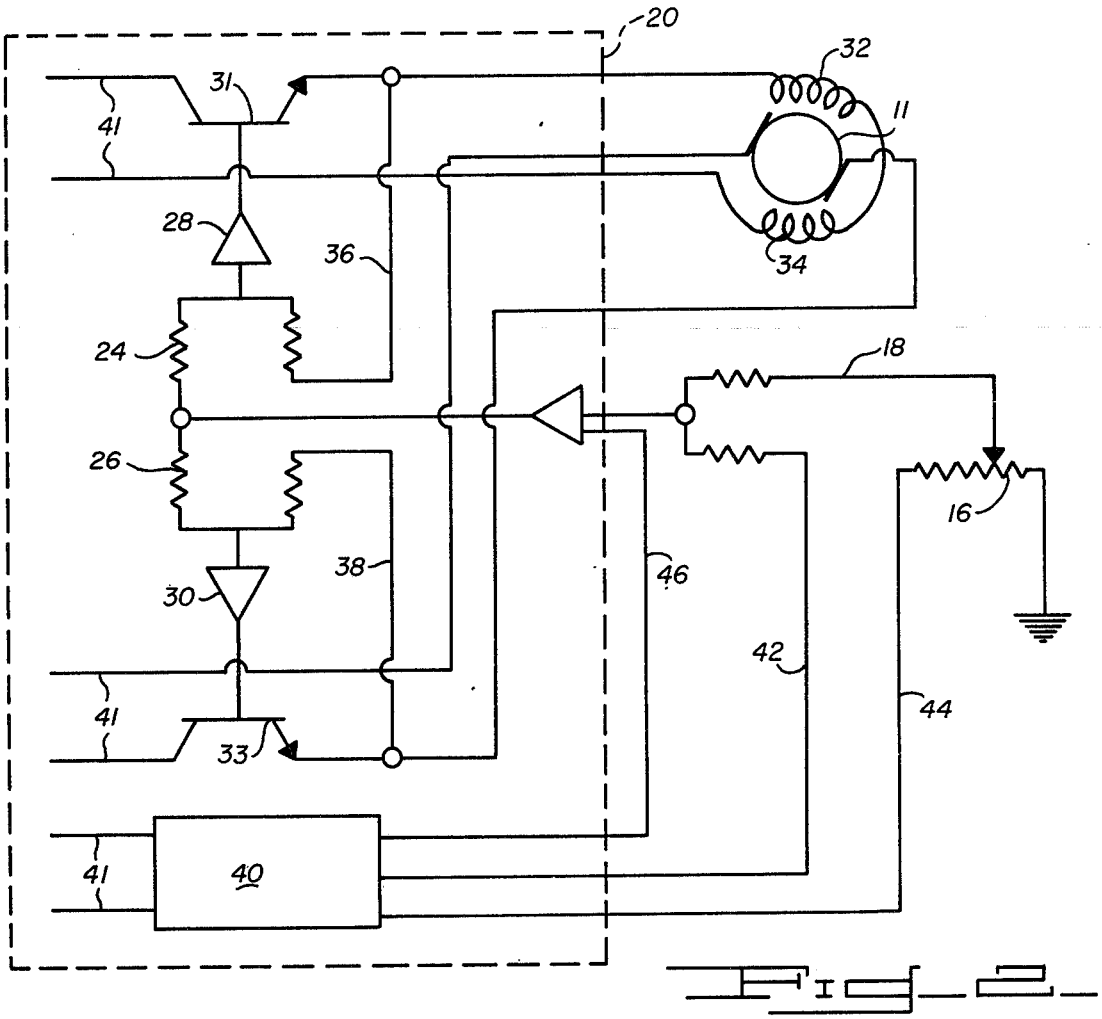
FIG. 1 shows a schematic view of the inventive mounting system operatively related to a gun.

Referring to FIG. 1, the invention is shown in connection with Gatling type cannon 10 having at least two barrels or typically as many as six or eight. The inventive system is adaptable for use with a variety of different weapons and recoil systems as well as ammunition types, hence cannon 10 is representive only. However, the inventive system is useful only in automatic weapons which are motor-driven in the sense that the rate of fire depends directly upon operating speed of a drive motor. This feature is characteristic of Gatling type weapons, such as modern 20 millimeter cannons or the like having a plurality of clustered barrels.

Gun 10 has a recoil system including spring pack 12 adapted to react the force resulting when a round is fired by the gun. Spring pack 12 or equivalent contains a low rate spring preloaded to just below the average recoil force desired. Pack 12 may comprise any of a multitude of conventional recoil systems known in the prior art and normally involving one or more coil springs which are compressed during recoil. The movable parts in a recoil mechanism are typically of such and scope of movement as necessary to dissipate as fully as possible the recoil force when a round is fired. Use of the inventive system disclosed herein requires adjustment of its variables to the operational characteristics of each weapon upon which it is mounted, as will appear more fully from the discussion below.

The moving parts displaced by recoil force of gun 10 include linearly movable yoke 14 operatively related to stationary spring pack 12 so that the yoke moves rearwardly during initial recoil and returns to a full forward position when firing stops, e.g. at the end of a gunfire burst. The amount and rate of yoke movement will naturally depend upon the kinetics of the individual weapon, but it is desirable is using the inventive system if yoke 14 is in relatively stable balance at some predictable distance rearwardly from its at-rest position. Stable balance in this instance refers to a condition in which the recoil force of a series of successively fired rounds at a controlled rate substantially equals the total counter-recoil forces applied to the recoiling parts by springs and the like combined with the inertial characteristics of such parts.

As further seen in FIG. 1, sensing means are operatively connected between the movable recoiling elements on gun 10 and the relatively stationary portions thereof. Thus, transducer 16 is secured to yoke 14 and is operatively associated with a contact element 18 or other suitable actuating device such as a potentiometer wiper or the like. A multitude of devices known to the prior art may be used to achieve the functions of transducer 16, including in some cases a conventional accelerometer. However, the preferred embodiment in this case employs a variable resistor capable of emitting an output signal proportional in amplitude to the relative position of yoke 14 and transducer 16 to stationary contact element 18.

The signal thus obtained from transducer 16 through contact 18 is conducted to motor control unit 20, which is shown schematically in FIG. 2. It will be understood that many different conventional devices may be used to perform the functions of unit 20, and no claim of novelty is asserted for its internal details suggested in FIG. 2. Control unit 20 includes a regulated power supply 40 of conventional type such as a trigger circuit so that gross variations in main power supply lines 41 will not affect gunfire control system operation. From the mentioned supply 40, a bias voltage is maintained to contact element 18 through lead 42 and a transducer voltage is applied to element 16 by lead 44. Another lead 46 supplies controlled voltage to amplifier 22, which sums the voltage from the transducer 16 and the bias to determine the voltage required for control. This amplified signal is fed through stablizing circuits 24 and 26 to separate final control amplifiers 28 and 30. Since motor 11 is preferably of the compound type, control voltage should desirably be provided both to armature and field windings. This is evidenced in FIG. 2 by amplifier 28 applying its output to field windings 32 and 34, while amplifier 30 is connected to armature windings in motor 11. The amplifier outputs are optionally fed through series regulators 31 and 33 as may be necessary to assure a high amperage signal accompanying the voltage, depending upon the operating requirements of motor 11. Feedback circuits 36 and 38 are incorporated to improve output voltage control of the regulators according to standard practice.

The position assumed by yoke 14 during a sustained gunfire burst will remain substantially constant throughout such burst if elements 11, 16, and 20 are properly adjusted. Position feedback is achieved by the invention system, whereby as the weapon recoil position shifts rearwardly for any reason, the speed of motor 11 is reduced, thereby decreasing the rate of fire from gun 10. This returns the weapon to its nominal firing position. If the weapon recoil is forward of the nominal position of balance, sensor 16, 18 will increase its voltage signal, causing control unit 20 to accelerate motor 11, increasing the firing rate of gun 10 and hence enlarging the recoil force until the stable balance position is reached.

Figure 3:
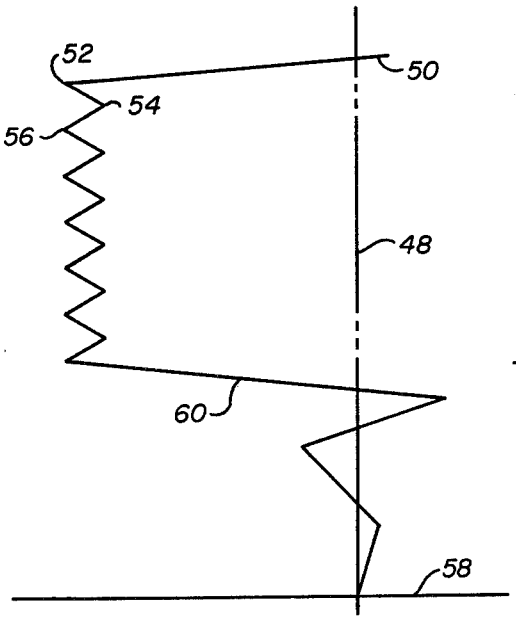
FIG. 3 shows a graphic relationship between elapsed time during gunfire burst and amount of recoil displacement.

The displacement characteristics of yoke 14 are graphically suggested in FIG. 3, wherein the ordinate 48 denotes time and the abscissa 58 displacement distance from neutral position of the yoke. Axis 48 in FIG. 3 is the neutral position with gun 10 at rest. Point 50 on the figure is the initial firing point of the first round in a burst. Rearward displacement of yoke 14 occurs until a maximum distance is reached at point 52, at which the gun begins counter-recoil movement until reaching a distance denoted by point 54. At this instant, another round is fired by gun 10, reacting the counter-recoil energy and moving yoke 14 rearwardly to point 56. This process is repeated until the final round of the burst, after which yoke 14 moves forwardly and again reaches its position 48 of neutral rest, as suggested by line 60. In a typical case, the elapsed time between each of the points 52 and 54, or 54 and 56, etc. is on the order of .08 seconds or less, and the maximum displacement distance between points 52 and axis 48 is about two inches or slightly less.

While a preferred embodiment has been described above, the teachings contained herein can be modified considerably without departing from the scope of the invention as defined in the claims which follow.

I claim:

1. In a recoil assembly adapted for use with an externally driven automatic weapon system including a gun tube assembly having a stationary mount and a motor for actuating operation of said system, the improvement comprising:

sensor means movable with said gun tube and capable of indicating the displacement of the gun tube in any position of recoil or counterrecoil movement, and control means operatively responsive to said sensor means for controlling operation of said motor, whereby the distance of recoil and counterrecoil travel of said gun tube may be controlled within predetermined limits.

2. The assembly of claim 1 wherein said sensor means includes a yoke member carried by the moving parts of the recoil assembly and a transducer means carried by the yoke, said transducer means being operatively responsive to the displacement of the yoke relative to the stationary mount to produce a signal indicating the relative displacement of the gun tube to the mount.

3. The assembly of claim 2 wherein said transducer means includes a variable resistor capable of emitting an output signal proportional in amplitude to the relative position of the yoke carried transducer to a stationary contact element carried by said mount.

4. The assembly of claim 3 wherein said control means includes a signal receiving device capable of receiving a signal generated by the sensor means.

5. The assembly of claim 4 wherein said control means includes:

a power source, means to apply a constant bias voltage to said contact element, means to apply a voltage to said transducer, a first amplifier for summing the transducer and bias voltages to determine the voltage required to control operation of said motor, stabilizing circuits for securing the signal fed from said amplifier, and final control amplifier means receiving the output of said stabilizing circuits and supplying the final control signal to said motor.

6. The assembly of claim 5 including series regulators receiving the output of the final control amplifiers and feedback circuits for enhancing the output voltage of said regulators.

7. In the method of controlling the displacement of gun tubes of automatic weapon systems having recoil and counterrecoil phases during firing thereof, the steps comprising:

mounting on the gun tube a sensor device capable of emitting a signal indicative of the displacement of the gun tube during the recoil and counterrecoil cycles thereof, receiving said signal with a motor control device capable of producing an output signal indicative of said gun tube displacement and applying said output signal to control operation of said motor, whereby the rate of gunfire may be controlled so that counterrecoil movement of said gun tube upon firing each round is substantially cancelled by firing of the next round and oscillatory shock levels transmitted through the gun mount are severely attenuated and converted to a relatively constant load value.

* * * * *